US009154894B2

(12) United States Patent
Shimizu

(10) Patent No.: US 9,154,894 B2
(45) Date of Patent: Oct. 6, 2015

(54) FREQUENCY CHARACTERISTICS DETERMINATION DEVICE

(71) Applicant: Onkyo Corporation, Osaka (JP)

(72) Inventor: Teppei Shimizu, Osaka (JP)

(73) Assignee: Onkyo Corporation, Neyagawa-shi (JP)

( * ) Notice: Subject to any disclaimer, the term of this patent is extended or adjusted under 35 U.S.C. 154(b) by 153 days.

(21) Appl. No.: 14/132,264

(22) Filed: Dec. 18, 2013

(65) Prior Publication Data

US 2014/0177872 A1 Jun. 26, 2014

(30) Foreign Application Priority Data

Dec. 26, 2012 (JP) ..... 2012-283022

(51) Int. Cl.
*H04R 3/04* (2006.01)
*H04R 29/00* (2006.01)

(52) U.S. Cl.
CPC . *H04R 29/00* (2013.01); *H04R 3/04* (2013.01)

(58) Field of Classification Search
None
See application file for complete search history.

(56) References Cited

U.S. PATENT DOCUMENTS

| | | | | |
|---|---|---|---|---|
| 7,460,768 | B2 * | 12/2008 | Tanner | 386/239 |
| 2006/0120549 | A1 * | 6/2006 | Burghardt | 381/351 |
| 2006/0251272 | A1 * | 11/2006 | Horbach | 381/99 |
| 2011/0096933 | A1 * | 4/2011 | Eastty | 381/56 |
| 2014/0038664 | A1 * | 2/2014 | Kim et al. | 455/550.1 |

FOREIGN PATENT DOCUMENTS

| | | |
|---|---|---|
| JP | 4132693 | 6/2008 |
| JP | 2011-517390 | 6/2011 |
| WO | WO 2009/112825 A1 | 9/2009 |

* cited by examiner

*Primary Examiner* — Thang Tran
(74) *Attorney, Agent, or Firm* — Renner, Otto, Boisselle & Sklar, LLP

(57) ABSTRACT

A frequency characteristics determination device that can prevent generation of a frequency response curve having an unnatural shape is provided. A CPU 11 sets pass points $P_i$ and $P_{i+1}$ through which the frequency response curve of an audio signal should pass. $P_{i+1}$ of a frequency $X_{pi+1}$ which is higher than a frequency $X_{pi}$ of the pass point $P_i$. The CPU 11 determines a direction point $a_i$ of a Bezier curve $C_i$ for connecting the pass points $P_i$ and $P_{i+1}$ based on the pass points $P_i$ and $P_{i+1}$. The CPU 11 determines whether a frequency $X_{ai}$ of the direction point $a_i$ is within a reference range between not less than the frequency $X_{pi}$ and not more than the frequency $X_{pi+1}$. When the frequency $X_{ai}$ is out of the reference range, the CPU 11 moves the direction point $a_i$ so that the frequency $X_{ai}$ is within the reference range.

8 Claims, 16 Drawing Sheets

FREQUENCY CHARACTERISTICS DETERMINATION DEVICE

BACKGROUND OF THE INVENTION

1. Field of the Invention

The present invention relates to a frequency characteristics determination device, and more specifically, relates to the frequency characteristics determination device for determining a frequency response curve of an audio signal.

2. Description of the Related Art

Equalizers change sound quality of audio signals according to predetermined frequency response curves. The equalizers contain a frequency characteristics determination device for determining frequency characteristics of audio signals, and use a frequency response curve determined by a frequency characteristics determination device.

Various methods for determining frequency characteristics are present. For example, a method for dividing an audio signal into a plurality of frequency bands, and determining a gain for each of the divided frequency bands is present.

Further, Japanese Unexamined Patent Application Publication No. 2011-517390 discloses a method for generating a curve that connects points specified by a user, and using the generated curve as a frequency response curve. In the invention of Japanese Unexamined Patent Application Publication No. 2011-517390, a plane where a frequency is set along an abscissa axis and a gain is set along an ordinate axis is displayed on a display. The user specifies desired points on the displayed plane. A curve that smoothly connects the specified points is automatically generated. An equalizer uses the generated curve as a frequency response curve.

In Japanese Unexamined Patent Application Publication No. 2011-517390, the frequency response curve is generated based on a frequency response of a shelving filter. Japanese Patent No. 4132693 discloses an equalizer for connecting specified points using spline interpolation so as to generate a frequency response curve.

A frequency characteristics determination device can generate a curve for smoothly connecting a plurality of specified points using a Bezier curve, and determine this curve as a frequency response curve. However, when the frequency response curve is generated by using the Bezier curve, the generated frequency response curve occasionally has an unnatural shape. For example, a generated frequency response curve occasionally draws a loop or an extremely large peak.

When the frequency response curve draws a loop, gains cannot be uniquely specified for a certain frequency. Further, when a frequency response curve draws an extremely large peak, an audio with a frequency related to the peak is enhanced beyond expectation, and an audio signal cannot be changed into one with a sound quality intended by a user.

SUMMARY OF THE INVENTION

It is an object of the present invention to provide a frequency characteristics determination device that can prevent generation of a frequency response curve having an unnatural shape.

A frequency characteristics determination device comprising: a setting section for setting a first pass point through which a frequency response curve of an audio signal should pass, and a second pass point whose frequency is higher than a frequency of the first pass point; a determination section for determining one or more direction points of a Bezier curve connecting the set first and second pass points based on the set first and second pass points; a range determination section for determining whether frequencies of the one or more direction points determined by the determination section are within a range between not less than the frequency of the first pass point and not more than the frequency of the second pass point; a moving section for moving the one or more direction points so that frequencies of the direction points are within the range when the determination is made that the frequencies of the direction points are out of the range; a generation section for generating a Bezier curve based on the one or more direction points and the first and second pass points; and a changing section for changing the frequency response curve of the audio signal according to the Bezier curve generated by the generation section.

According to the present invention, one or more direction points of a Bezier curve connecting first and second pass points are present within a range of not less than a frequency of the first pass point to not more than a frequency of the second pass point. As a result, when frequency response curve of an audio signal is determined by using a Bezier curve, the frequency response curve can be prevented from having an unnatural shape.

Preferably, wherein the one or more direction points include first and second direction points, the range determination section determines whether each of the first and second direction points is within the range.

According to the present invention, a frequency response curve of an audio signal can be determined by using three or more Bezier curves.

Preferably, wherein a first tangent of the Bezier curve at the first pass point passes through the first direction point, a second tangent of the Bezier curve at the second pass point passes through the second direction point, and the moving section moves the first direction point along the first tangent, and moves the second direction point along the second tangent.

According to the present invention, a great change in the shape of the Bezier curve before and after first and second direction points can be suppressed.

Preferably, wherein when the frequency of the first direction point is lower than the frequency of the first pass point, the moving section makes the frequency of the first direction point match with the frequency of the first pass point, and when the frequency of the second direction point is lower than the frequency of the first pass point, the moving section makes the frequency of the second direction point match with the frequency of the first pass point, and when the frequency of the first direction point is higher than the frequency of the second pass point, the moving section makes the frequency of the first direction point match with the frequency of the second pass point, and when the frequency of the second direction point is higher than the frequency of the second pass point, the moving section makes the frequency of the second direction point match with the frequency of the second pass point.

According to the present invention, when the first or second direction point is moved, a moving amount of the first or second direction point can be suppressed.

Preferably, further comprising: a comparing section for comparing the frequency of the first direction point with the frequency of the second direction point, wherein when the comparing section determines that the frequency of the first direction point is higher than the frequency of the second direction point, the moving section moves at least one of the first and second direction points so that the frequency of the first direction point is not more than the frequency of the second direction point.

According to the present invention, since the frequency of the first direction point is not more than the frequency of the second direction point, a frequency response curve for enabling gains to be uniquely specified for the frequency can be generated.

A frequency characteristics determination device comprising: a setting section for setting a first pass point through which a frequency response curve of an audio signal should pass, and a second pass point whose frequency is higher than a frequency of the first pass point; a determination section for determining first and second direction points of a Bezier curve connecting the set first and second pass points based on the set first and second pass points; a comparing section for comparing a first frequency of the first direction point through which a tangent of the Bezier curve at the first pass point passes with a second frequency of the second direction point through which a tangent of the Bezier curve at the second pass point passes; a moving section for, when the comparing section determines that the first frequency is higher than the second frequency, moving at least one of the first and second direction points so that the first frequency is not more than the second frequency; a generation section for generating a Bezier curve based on the first and second pass points and the first and second direction points; and a changing section for changing the frequency response curve of the audio signal according to the Bezier curve generated by the generation section.

According to the present invention, at least one of the first and second direction points can be moved so that a first frequency is not more than a second frequency. As a result, when frequency response curve of an audio signal is determined by using a Bezier curve, the frequency response curve can be prevented from having an unnatural shape.

A recording medium in which a control program is stored, the control program allowing a computer installed into a frequency characteristics determination device to execute: a step of setting a first pass point through which a frequency response curve of an audio signal should pass and a second pass point whose frequency is higher than a frequency of the first pass point; a step of determining one or more direction points of a Bezier curve connecting the set first and second pass points based on the set first and second pass points; a step of determining whether frequencies of the determined one or more direction points are within a range between not less than the frequency of the first pass point and not more than the frequency of the second pass point; a step of moving the one or more direction points so that frequencies of the one or more direction points are within the range when the determination is made that the frequencies of the one or more direction points are out of the range; a step of generating a Bezier curve based on the one or more direction points and the first and second pass points; a step of changing the frequency response curve of the audio signal according to the generated Bezier curve.

According to the present invention, one or more direction points of a Bezier curve connecting first and second pass points are present within a range of not less than a frequency of the first pass point to not more than a frequency of the second pass point. As a result, when frequency response curve of an audio signal is determined by using a Bezier curve, the frequency response curve can be prevented from having an unnatural shape.

A recording medium in which a control program is stored, the control program allowing a computer installed into a frequency characteristics determination device to execute: a step of setting a first pass point through which a frequency response curve of an audio signal should pass and a second pass point whose frequency is higher than a frequency of the first pass point; a step of determining first and second direction points of a Bezier curve connecting the set first and second pass points based on the set first and second pass points; a step of comparing a first frequency of the first direction point through which a tangent of the Bezier curve at the first pass point passes with a second frequency of the second direction point through which a tangent of the Bezier curve at the second pass point passes; a step of, when a determination is made that the first frequency is higher than the second frequency, moving at least one of the first and second direction points so that the first frequency is not more than the second frequency; a step of generating a Bezier curve based on the first and second pass points and the first and second direction points; and a step of changing the frequency response curve of the audio signal according to the generated Bezier curve.

According to the present invention, at least one of the first and second direction points can be moved so that a first frequency is not more than a second frequency. As a result, when frequency response curve of an audio signal is determined by using a Bezier curve, the frequency response curve can be prevented from having an unnatural shape.

DETAILED DESCRIPTION OF THE PREFERRED EMBODIMENTS

Figure 1:
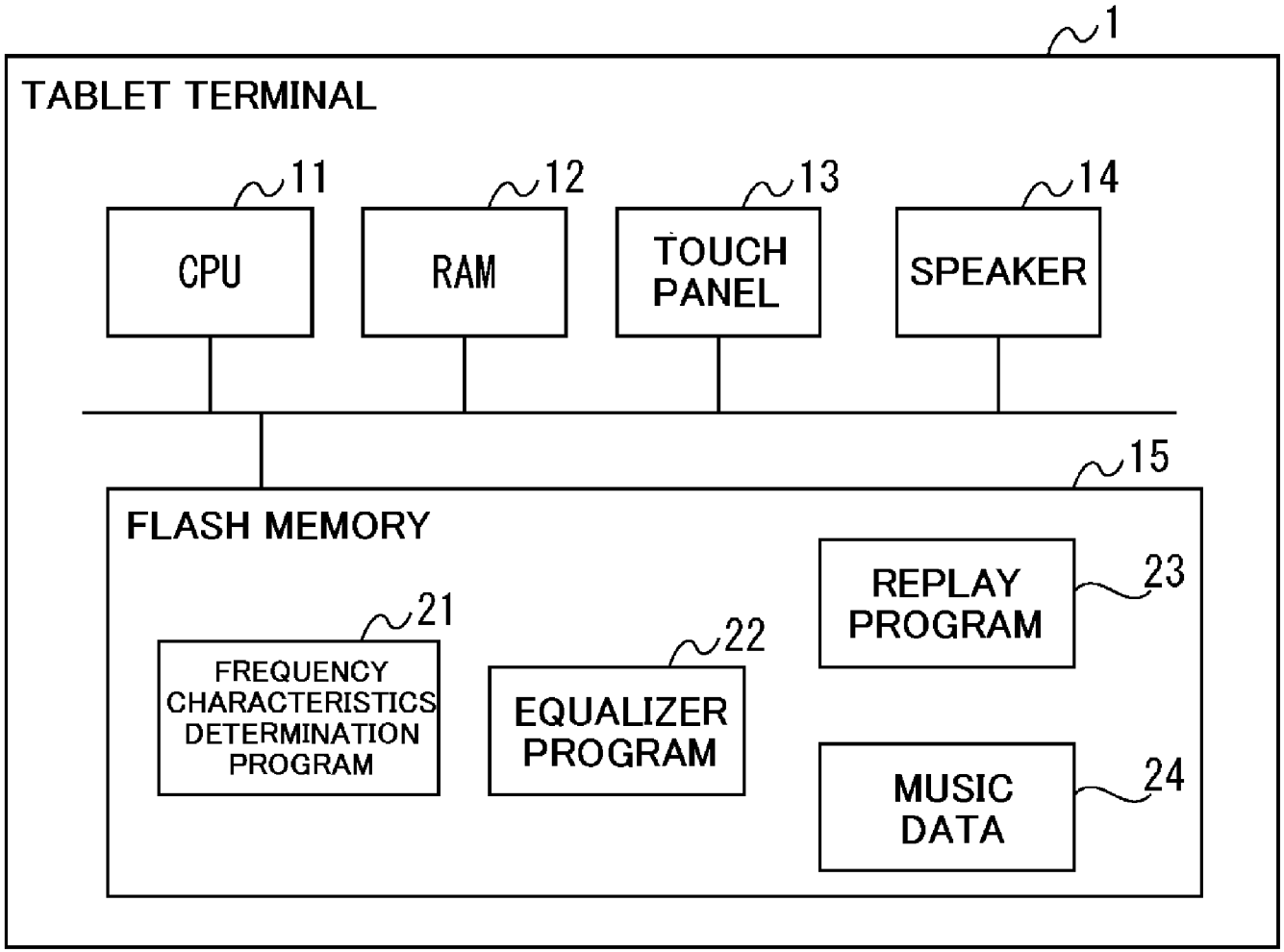
FIG. 1 is a functional block diagram illustrating a constitution of a tablet terminal according to an embodiment of the present invention.

An embodiment of the present invention is described in detail below with reference to the drawings. The same or corresponding parts in the drawings are denoted by the same symbols, and description thereof is not repeated.

{1. Constitution of Tablet Terminal}

FIG. 1 is a functional block diagram illustrating a constitution of a tablet terminal 1 according to the embodiment of the present invention. In FIG. 1, the tablet terminal 1 is a computer that operates as a frequency characteristics determination device when a frequency characteristics determination program 21 is installed. In the embodiment, the frequency characteristics determination device determines a frequency response curve of an audio signal. The frequency response curve is used when an equalizer changes a sound quality of an audio signal.

The tablet terminal 1 includes a CPU (Central Processing Unit) 11, a RAM (Random Access Memory) 12, a touch panel 13, a speaker 14, and a flash memory 15.

The CPU 11 loads various programs stored in the flash memory 15 into the RAM 12, and executes the loaded programs so as to control the tablet terminal 1. The RAM 12 is a main memory of the tablet terminal 1.

The touch panel 13 displays a setting screen for a frequency response curve of an audio signal. The touch panel 13 outputs a position touched by a user as operation information.

The speaker 14 outputs an audio signal that is reproduced by the tablet terminal 1 as an audio.

The flash memory 15 is a non-volatile semiconductor memory, and stores the frequency characteristics determination program 21 (hereinafter, referred to as "the determination program 21"), an equalizer program 22, a replay program 23, and music data 24.

The music data 24 is an audio signal that is compressed by an MP3 (MPEG Audio Layer-3) system. An audio signal compression system may be one other than MP3. The replay program 23 is a program for decoding the music data 24 so as to generate an audio signal. The equalizer program 22 is a program for changing a sound quality of an audio signal generated by the replay program 23 based on the frequency response curve determined by the determination program 21. The determination program 21 is a program for generating a frequency response curve according to user's operations. Details of the determination program 21 will be described later.

FIG. 1 illustrates the determination program 21, the equalizer program 22, and the replay program 23 as independent programs, but the present invention is not limited to this. For example, the determination program 21 may be included in the equalizer program 22. The determination program 21 and the equalizer program 22 may be included in the replay program 23.

{2. Outline of the Frequency Characteristics Determination Program 21}

The determination program 21 is a program for generating a Bezier curve that passes through pass points set by the user, and determining the frequency response curve of the audio signal using the Bezier curve.

Figure 2:
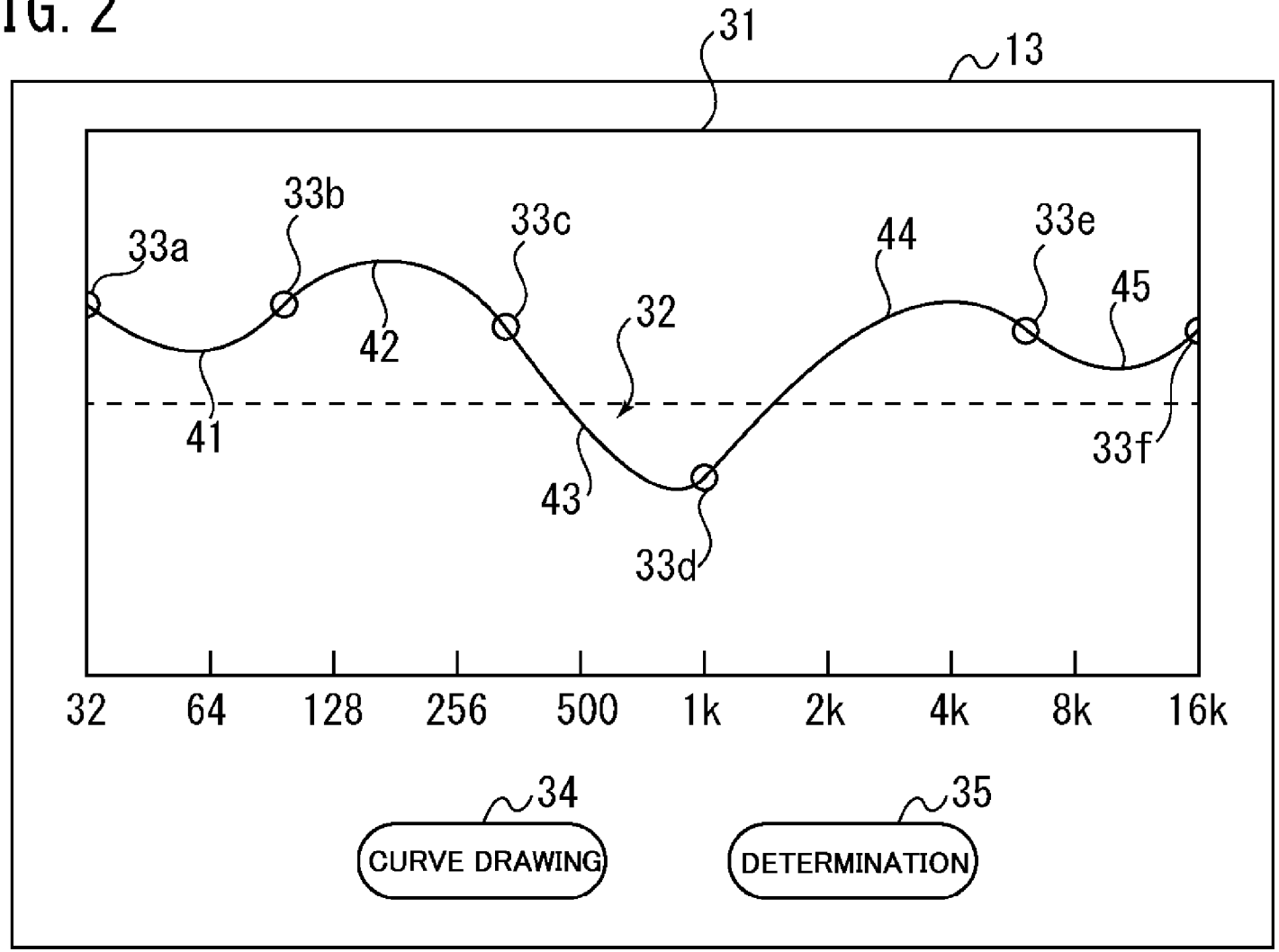
FIG. 2 is a diagram illustrating a setting screen to be displayed on a touch panel shown in FIG. 1.

FIG. 2 is a diagram illustrating a setting screen 31 of the frequency response curve to be displayed on the touch panel 13. The CPU 11 runs the determination program 21 so as to display the setting screen 31 on the touch panel 13 as shown in FIG. 2. When the setting screen 31 is first displayed on the touch panel 13, a frequency response curve 32 is not displayed on the setting screen 31. The user touches a plurality of desired positions on the displayed setting screen 31. The touched positions are set as pass points 33*a* to 33*f* through which the frequency response curve 32 should pass.

The CPU 11 generates a Bezier curve for connecting adjacent two pass points. Concretely, a Bezier curve 41 for connecting the pass points 33*a* and 33*b*, a Bezier curve 42 for connecting pass points 33*b* and 33*c*, a Bezier curve 43 for connecting pass points 33*c* and 33*d*, a Bezier curve 44 for connecting pass points 33*d* and 33*e*, and a Bezier curve 45 for connecting pass points 33*e* and 33*f* are generated. The Bezier curves 41 to 45 are essentially generated so as to smoothly connect the pass points. The frequency response curve of an audio signal is changed based on the generated Bezier curves 41 to 45.

{3. Operation of the Frequency Characteristics Determination Program 21}

An operation of the tablet terminal 1 for running the determination program 21 will be described in detail below.

{3.1. Basic Flow}

Figure 3:
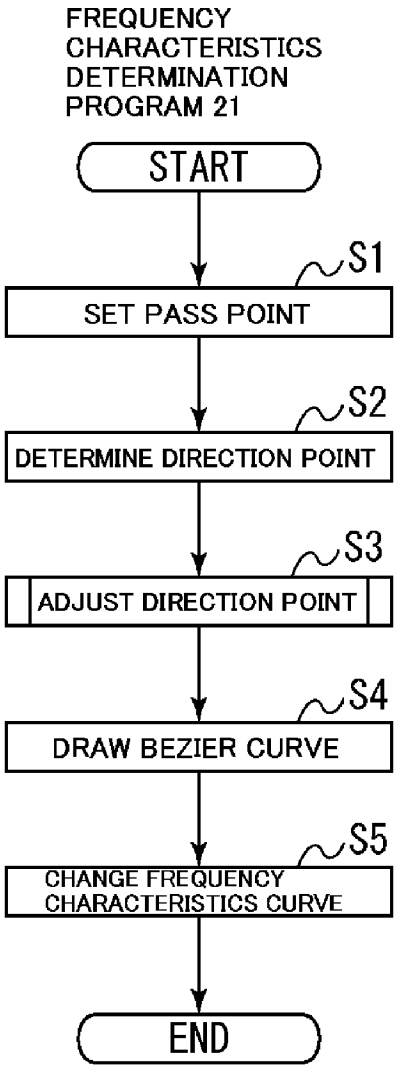
FIG. 3 is a flowchart of a frequency characteristics determination program shown in FIG. 1.

FIG. 3 is a flowchart illustrating the operation of the tablet terminal 1 for running the determination program 21. The CPU 11 displays the setting screen 31 on the touch panel 13, and accepts setting of the pass points (step S1) as shown in FIGS. 2 and 3. The CPU 11 determines direction points of a third Bezier curve for connecting the adjacent two pass points (step S2). The direction points are points through which a tangent of the Bezier curve at the pass points passes. Hereinafter, the third Bezier curve is simply referred to as "Bezier curve" unless otherwise noted. Details of step S2 will be described later.

The CPU 11 adjusts the positions of the direction points determined at step S2 (step S3). In the frequency response curve determined based on the Bezier curve, gains cannot be uniquely determined for a frequency in some cases. The CPU 11 adjusts the positions of the direction point and changes the shape of the Bezier curve in order to enable the gains to be uniquely determined. Details of step S3 will be described later.

When a curve drawing button 34 is touched by the user, the CPU 11 generates the Bezier curves 41 to 45 using the pass points and the direction points whose positions are adjusted so as to draw it on the setting screen 31 (step S4). When the drawn Bezier curves 41 to 45 are used as the frequency response curve, the user touches a determination button 35. The CPU 11 determines a curve that connects the generated Bezier curves 41 to 45 as a new frequency response curve 32, so as to change the frequency response curve 32 (step S5).

When the user desires to correct the shapes of the drawn Bezier curves 41 to 45, the user may set the pass points again (step S1). The user can move the positions of the pass points on the setting screen 31, or can add new pass points. In this case, the CPU 11 repeats the processing at steps S2 to S4 so as to draw a new Bezier curve.

{3.2. Determination of Direction Point (step S2)}

Figure 4:
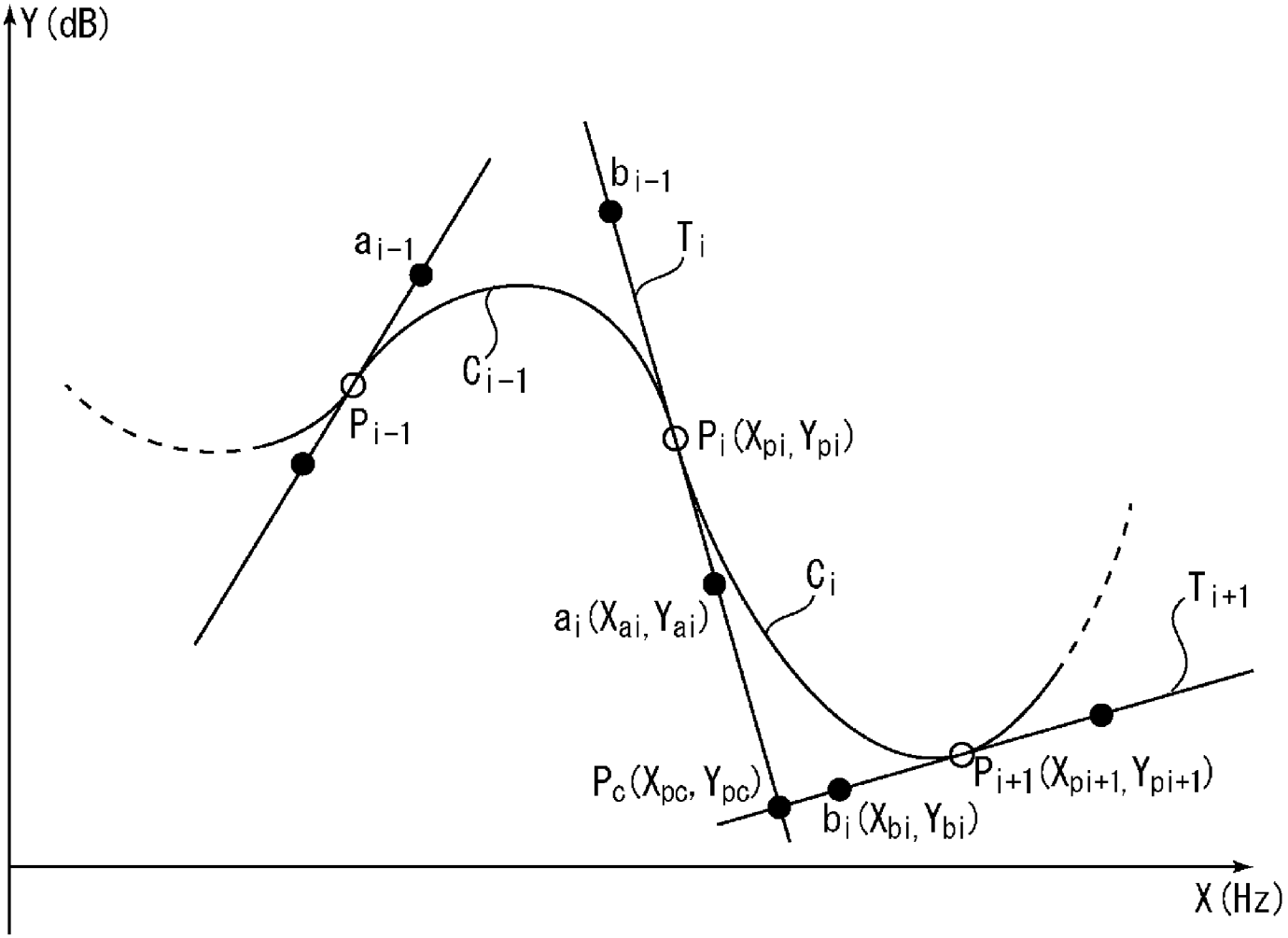
FIG. 4 is a diagram describing a principle that the Bezier curve shown in FIG. 2 is generated.

FIG. 4 is a diagram describing a principle that the Bezier curve for connecting the adjacent two pass points is generated. In FIG. 4, an abscissa axis represents a frequency, and an ordinate axis represents a gain. It is assumed that n (n: an integer of 2 or more) -numbered pass points $P_i$ are already set as shown in FIG. 4. "i" denotes a natural number of 1 or more to n−1 or less. The pass points $P_1$, $P_2$, . . . , $P_n$ are set in increasing order of the frequency.

A Bezier curve $C_{i-1}$ connects the pass point $P_{i-1}$ and the pass point $P_i$ that are adjacent to each other. A Bezier curve $C_i$ connects the pass point $P_i$ and the pass point $P_{i+1}$ that are adjacent to each other. The CPU 11 determines the direction points such that the Bezier curve $C_i$ smoothly joints to Bezier curve $C_{i+1}$ at step S2.

When the Bezier curves $C_{i-1}$ and $C_i$ smoothly connect to each other at the pass point $P_i$, the Bezier curves $C_{i-1}$ and $C_i$ are C2 continuous, and satisfy the following formulas (1) and (2):

Mathematical Formula 1

$$\frac{dC_{i-1}(1)}{dt} = \frac{dC_i(0)}{dt} \tag{1}$$

Mathematical Formula 2

$$\frac{d^2 C_{i-1}(1)}{dt^2} = \frac{d^2 C_i(0)}{dt^2} \tag{2}$$

"C2 continuous" means that values obtained by two differentials are continuous. In the formulas (1) and (2), $C_{i-1}$ and $C_i$ are expressed as a function of t. "t" denotes a variable of 0 or more to 1 or less. $C_{i-1}(1)$ denotes an end point (the pass point $P_i$) of the Bezier curve $C_{i-1}(0)$ denotes a start point (the pass point $P_i$) of the Bezier curve $C_i$. The formula (1) indicates that a tilt of a tangent at the end point in the Bezier curve $C_{i-1}$ matches with a tilt of a tangent at the start point of the Bezier curve $C_i$. The formula (2) indicates that a curvature at the end point of the Bezier curve $C_{i-1}$ matches with a curvature at the start point of the Bezier curve $C_i$.

According to the characteristics of the third Bezier curve, $C_{i-1}(t)$ and $C_i(t)$ satisfy the following formulas (3) to (6):

Mathematical Formula 3

$$\frac{dC_i(0)}{dt} = 3\cdot(a_i - P_i) \tag{3}$$

Mathematical Formula 4

$$\frac{dC_{i-1}(1)}{dt} = 3\cdot(P_i - b_{i-1}) \tag{4}$$

Mathematical Formula 5

$$\frac{d^2 C_i(0)}{dt^2} = 6\cdot(b_i - 2a_i + P_i) \tag{5}$$

Mathematical Formula 6

$$\frac{d^2 C_{i-1}(1)}{dt^2} = 6\cdot(P_i - 2b_{i-1} + a_{i-1}) \tag{6}$$

In the formulas (3) to (6), $a_i$ and $b_i$ denote the direction points of the Bezier curve $C_i$. The direction point $a_i$ determines the direction of a tangent at the pass point $P_i$ (start point) of the Bezier curve $C_i$. The direction point $b_i$ determines the direction of a tangent at the pass point $P_{i+1}$ (the end point) of the Bezier curve $C_i$.

When the formulas (3) to (6) are solved, the following formulas (7) and (8) can be obtained:

Mathematical Formula 7

$$3\cdot(a_i-P_i)=3\cdot(P_i-b_{i-1}) \tag{7}$$

Mathematical Formula 8

$$6\cdot(b_i-2a_i+P_i)=6\cdot(P_i-2b_{i-1}+a_{i-1}) \tag{8}$$

When the formulas (7) and (8) are solved, the following formulas (9) and (10) can be obtained:

Mathematical Formula 9

$$a_i+b_{i-1}=2P_i \tag{9}$$

Mathematical Formula 10

$$-2b_{i-1}+a_{i-1}-b_i+2a_i=0 \tag{10}$$

The direction points $a_1, a_2, \ldots, a_{n-1}$, and the direction points $b_1, b_2, \ldots, b_{n-1}$ that satisfy the formulas (9) and (10) are acquired, so that the direction points that smoothly connect the Bezier curve $C_1$ to $C_{n-1}$ are determined. In order to solve the formulas (9) and (10), a condition such that secondary differentiations at the pass points $P_1$ and $P_n$ at both the ends are 0 is added. This condition is represented by the following formulas (11) and (12):

Mathematical Formula 11

$$b_1-2a_1+P_i=0 \tag{11}$$

Mathematical Formula 12

$$P_n-2b_{n-1}-a_{n-1}=0 \tag{12}$$

{3.3. Adjustment of Direction Points (step S3)}

The CPU 11 adjusts the positions of the direction points determined at step S2 (step S3). A reason why the positions of the direction points are adjusted will be described.

Figure 5:
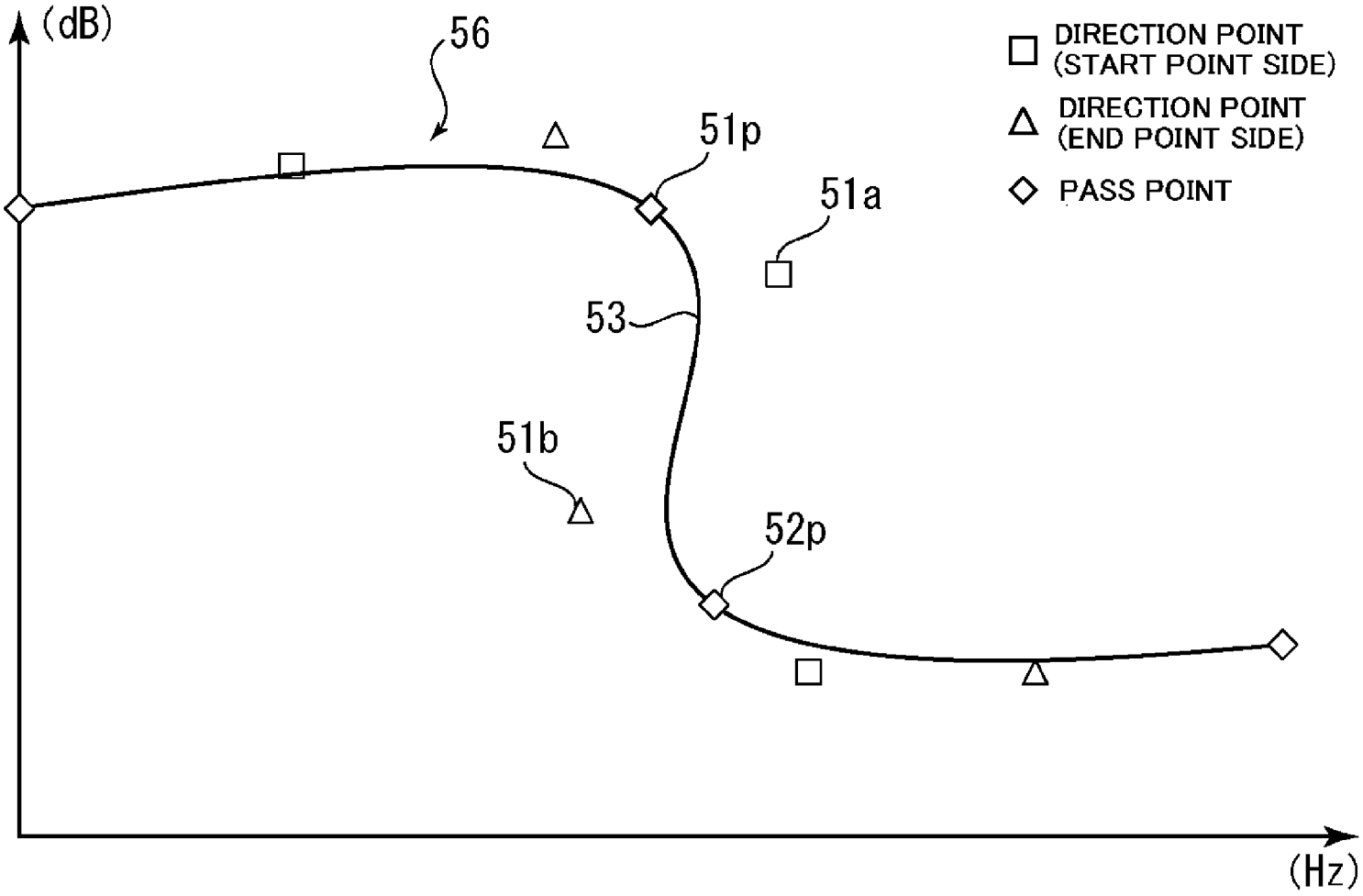
FIG. 5 is a graph illustrating one example of the Bezier curve shown in FIG. 3 that is drawn without executing direction point adjustment processing.
Figure 6:
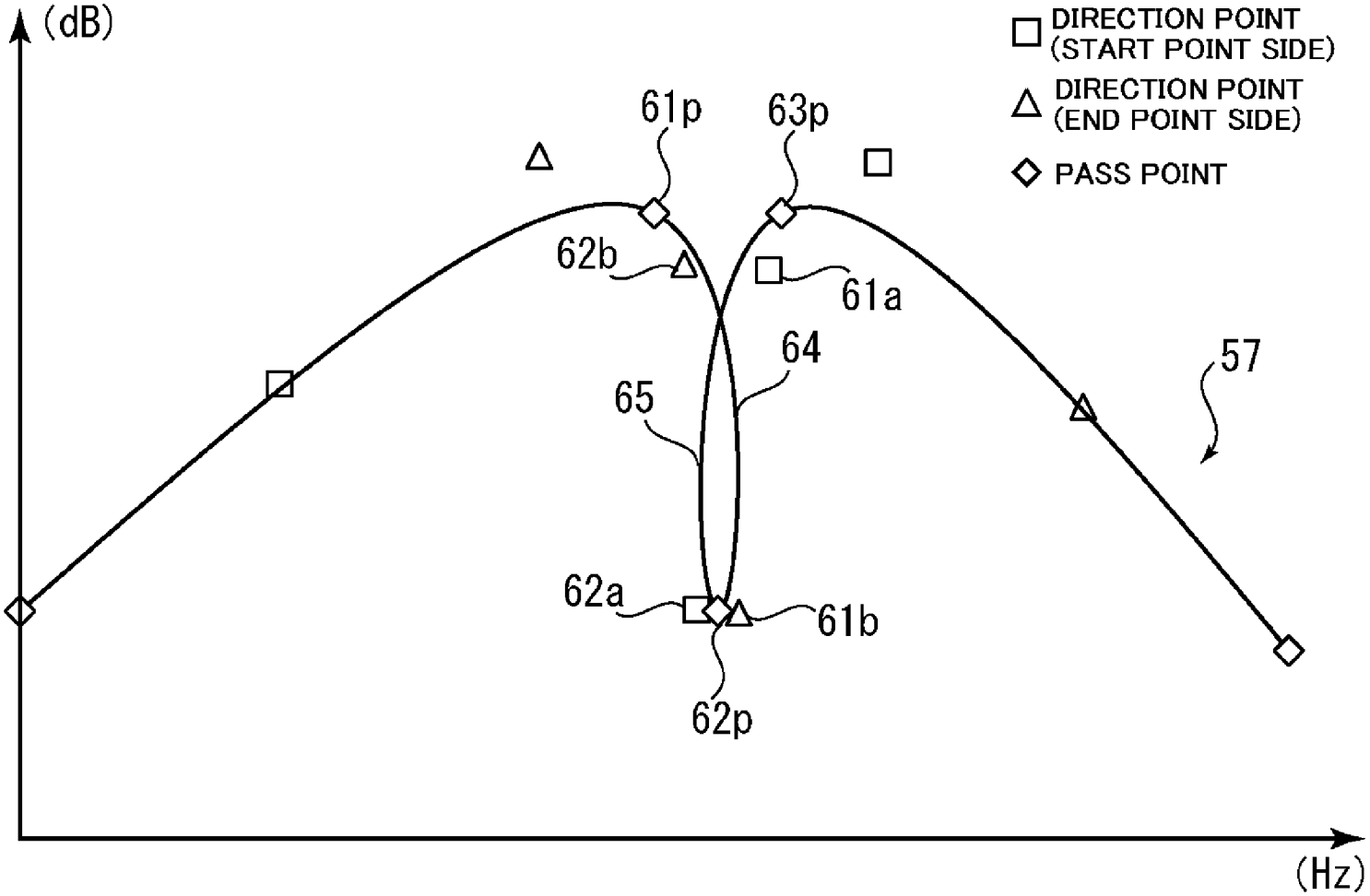
FIG. 6 is a graph illustrating another example of the Bezier curve shown in FIG. 3 that is drawn without executing the direction point adjustment processing.

FIGS. 5 and 6 are diagrams illustrating Bezier curves generated based on the direction points before the positions are adjusted. A Bezier curve 53 that connects pass points 51*p* and 52*p* has an S shape as shown in FIG. 5. A Bezier curve 64 connects pass points 61*p* and 62*p*, and a Bezier curve 65 connects pass points 62*p* and 63*p* as shown in FIG. 6. The Bezier curves 64 and 65 draw a spiral. A frequency region where the gains of an audio signal cannot be uniquely specified is present in a frequency response curve 56 including the Bezier curve 53, and a frequency response curve 57 including the Bezier curves 64 and 65. Direction points 51*a*, 51*b*, 61*a*, 61*b*, 62*a*, and 62*b* will be described later.

Therefore, the CPU 11 moves the direction points that satisfy a predetermined condition so that the positions of the direction points are adjusted. As a result, even when a Bezier curve is used, a frequency response curve for enabling gains to be uniquely specified can be drawn.

Figure 7:
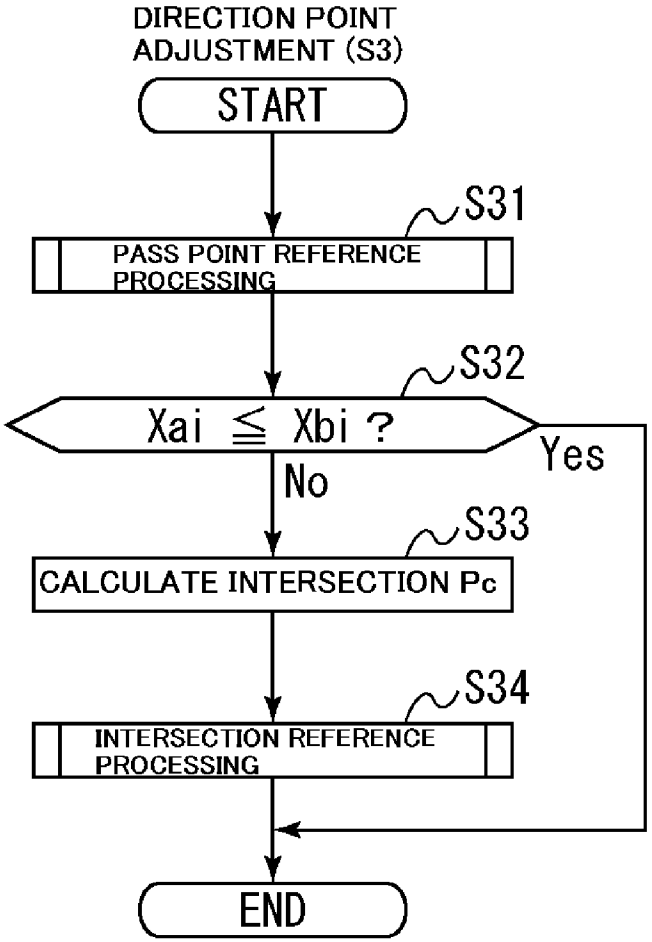
FIG. 7 is a flowchart of the direction point adjustment processing shown in FIG. 3.

FIG. 7 is a flowchart of a direction point adjustment processing (step S3) shown in FIG. 3. The CPU 11 executes a processing at steps S31 to S34 for each of the Bezier curves $C_i$ as shown in FIG. 7.

The CPU 11 executes pass point reference processing for adjusting the positions of the direction points $a_i$ and $b_i$ based on the positions of the pass points $P_i$ and $P_{i+1}$ as shown in FIGS. 4 and 7 (step S31). The direction points $a_i$ and $b_i$ are moved within a reference range by the pass point reference processing. The reference range means the frequency or more of the start point (the pass point $P_i$) of the Bezier curve $C_i$ to the frequency or less of the end point (the pass point $P_{i+1}$) of the Bezier curve $C_i$. Details of the pass point reference processing (step S31) will be described later.

The CPU 11 compares a frequency $X_{ai}$ of the direction point $a_i$ with a frequency $X_{bi}$ of the direction point $b_i$ (step S32). When the frequency $X_{ai}$ is the frequency $X_{bi}$ or less (Yes at step S32), the CPU 11 ends the direction point adjustment processing (step S3).

On the other hand, when the frequency $X_{ai}$ is higher than the frequency $X_{bi}$ (No at step S32), the CPU 11 calculates an intersection $P_c$ between a tangent $T_i$ of the Bezier curve $C_i$ at the direction point $a_i$ and a tangent $T_{i+1}$ of the Bezier curve $C_i$ at the direction point $b_i$ (step S33). When the direction points $a_i$ and $b_i$ move in the pass point reference processing (step S31), the moved direction points $a_i$ and $b_i$ are used for the calculation of the intersection $P_c$. The CPU 11 executes intersection reference processing (step S34) for adjusting the positions of the direction points $a_i$ and $b_i$ according to the position of the intersection $P_c$. Details of the intersection reference processing (step S34) will be described later.

{3.4. Pass Point Reference Processing (step S31)}

Figure 8:
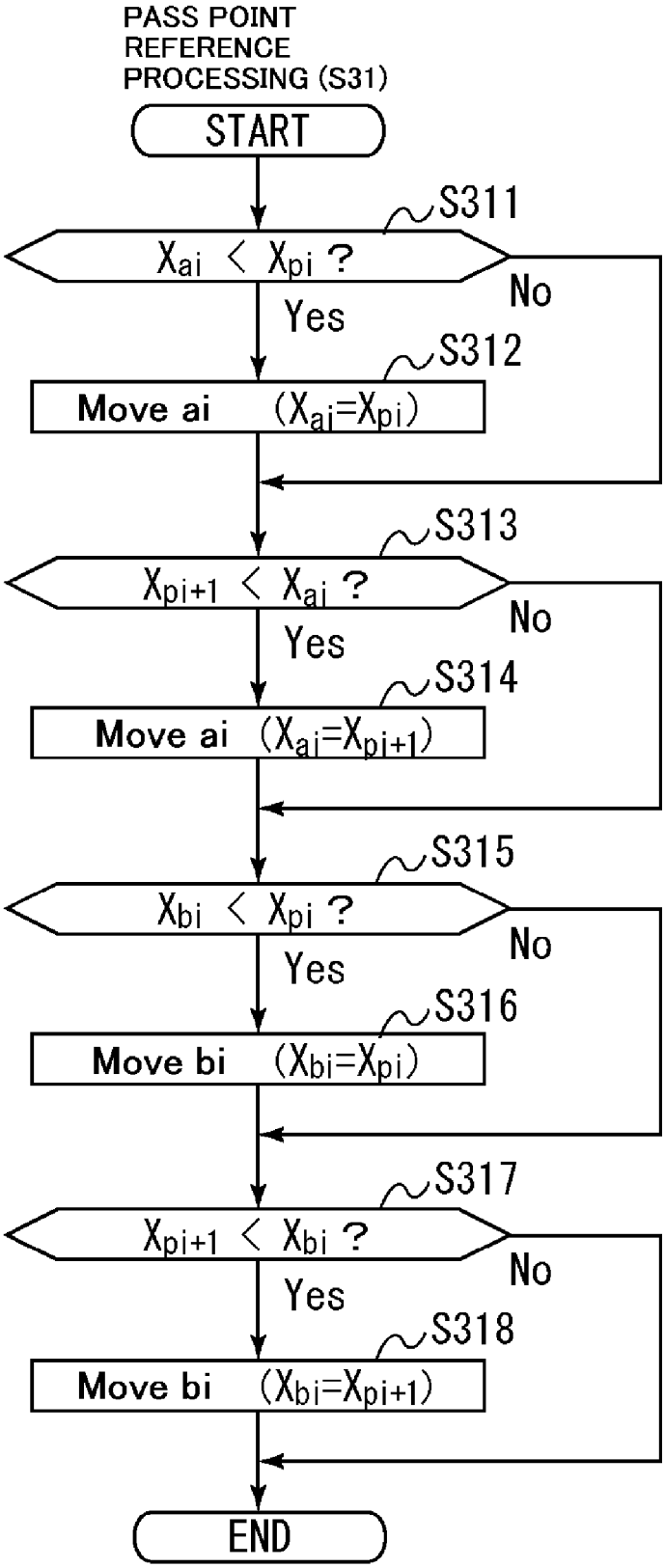
FIG. 8 is a flowchart of pass point reference processing shown in FIG. 7.

FIG. 8 is a flowchart of the pass point reference processing (step S31). The CPU 11 executes steps S311 to S314 as shown in FIGS. 4 and 8, and moves the direction point $a_i$ so that the direction point $a_i$ is within the reference range.

Figure 9:
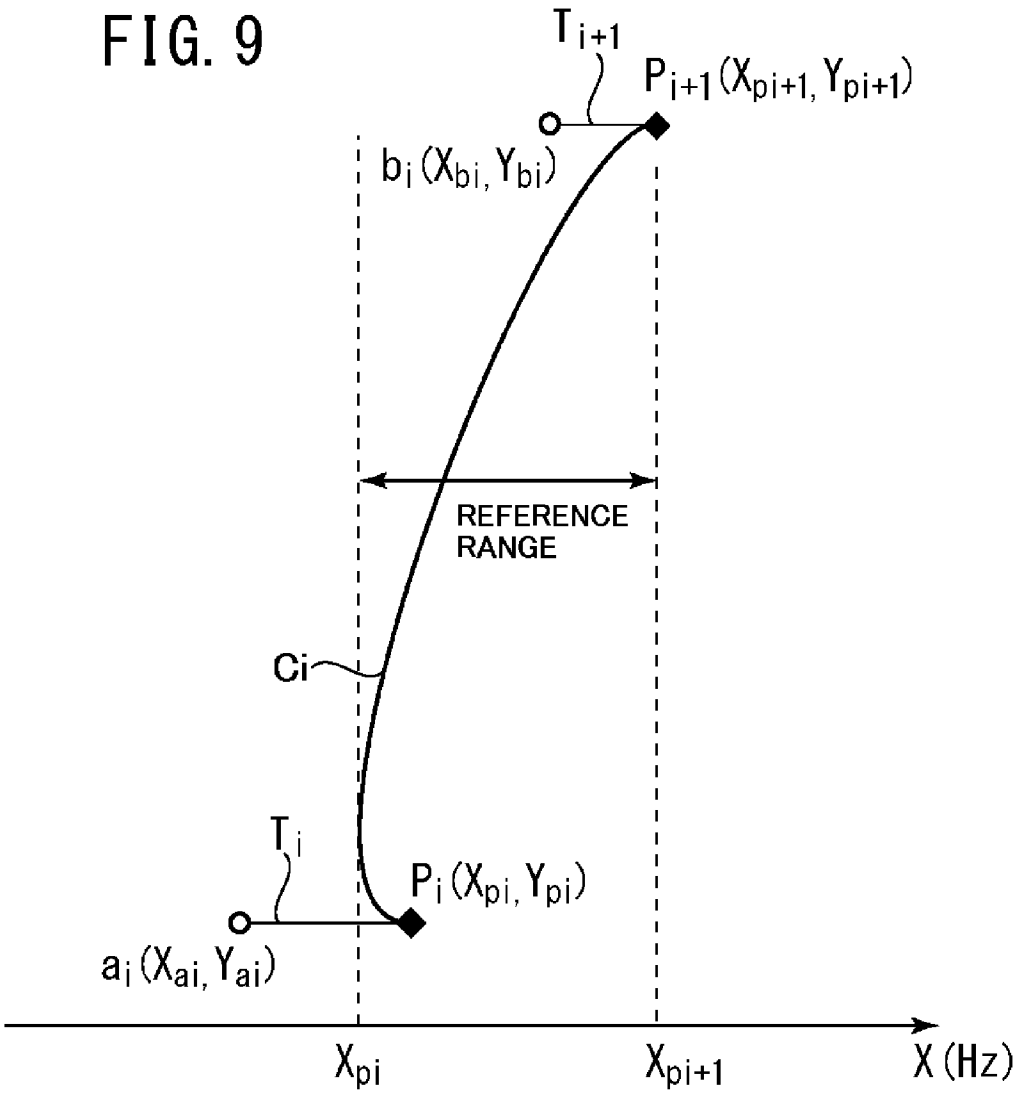
FIG. 9 is a diagram illustrating one example of the Bezier curve show in FIG. 7 before the pass point reference processing is executed.

FIG. 9 is a diagram illustrating the Bezier curve $C_i$ in a case where the frequency $X_{ai}$ of the direction point $a_i$ is lower than the frequency $X_{pi}$ of the pass point $P_i$. When the frequency $X_{ai}$ is lower than the frequency $X_{pi}$ (Yes at step S311), the Bezier curve $C_i$ passes through a region of the frequency lower than the frequency $X_{pi}$ as shown in FIGS. 8 and 9. This causes a frequency response curve to have a loop shape. The CPU 11 moves the direction point $a_i$ in the direction of the tangent $T_i$, and makes the frequency $X_{ai}$ match with the frequency $X_{pi}$ (step S312). As a result, the Bezier curve $C_i$ is prevented from passing through a region where the frequency is lower than the frequency $X_{pi}$.

On the other hand, when the frequency $X_{ai}$ is not less than the frequency $X_{pi}$ (No at step S311), the CPU 11 proceeds to step S313.

Figure 10:
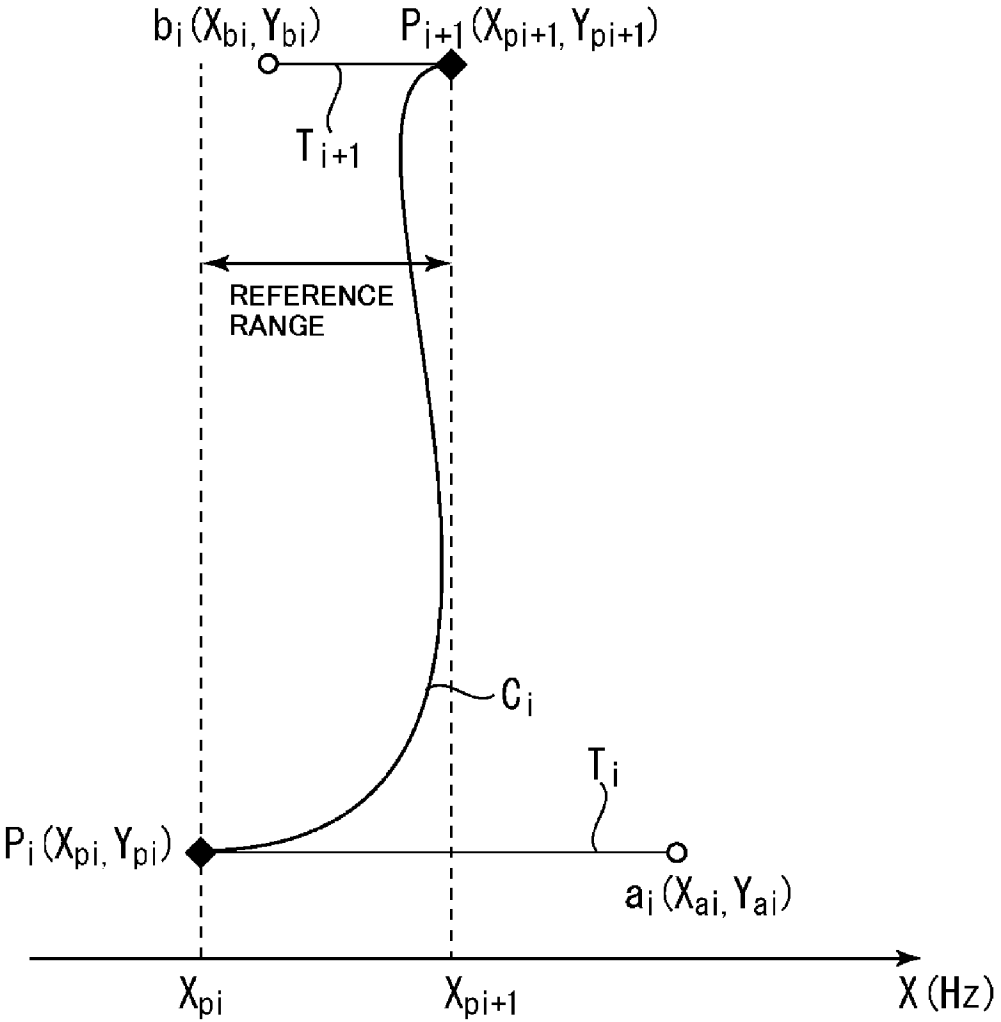
FIG. 10 is a diagram illustrating another example of the Bezier curve shown in FIG. 7 before the pass point reference processing is executed.

FIG. 10 is a diagram illustrating the Bezier curve $C_i$ in a case where the frequency $X_{ai}$ of the direction point $a_i$ is higher than a frequency $X_{pi+1}$ of the pass point $P_{i+1}$. When the frequency $X_{ai}$ is higher than the frequency $X_{pi+1}$ (Yes at step S313) as shown in FIGS. 8 and 10, a plurality of gains is related to one frequency on the Bezier curve $C_i$. In this case, the CPU 11 moves the direction point $a_i$ to the direction of the tangent $T_i$, so as to make the frequency $X_{ai}$ match with the frequency $X_{pi+1}$ (step S314). As a result, the gains can be uniquely specified on the Bezier curve $C_i$.

On the other hand, when the frequency $X_{ai}$ is not more than the frequency $X_{pi+1}$ (No at step S313), the CPU 11 proceeds to step S315.

When the direction point $a_i$ is present within the reference range (No at step S311, No at step S313), the CPU 11 does not move the direction point $a_i$.

The CPU 11, then, executes steps S315 to S318, and moves the direction point $b_i$ so that the direction point $b_i$ is within the reference range.

Figure 11:
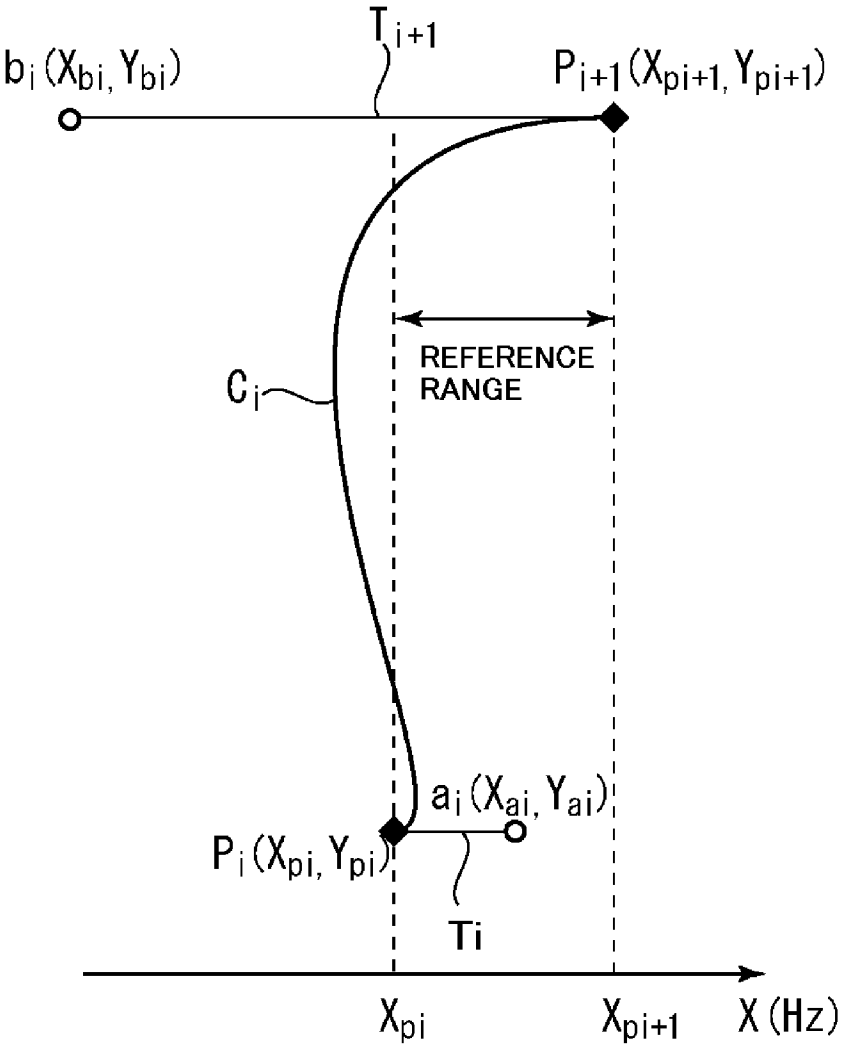
FIG. 11 is a diagram illustrating another example of the Bezier curve shown in FIG. 7 before the pass point reference processing is executed.

FIG. 11 is a diagram illustrating the Bezier curve $C_i$ in a case where the frequency $X_{bi}$ of the direction point $b_i$ is lower than the frequency $X_{pi}$ of the pass point $P_i$. When the frequency $X_{bi}$ is lower than the frequency $X_{pi}$ (Yes at step S315), a plurality of gains is related to one frequency on the Bezier curve $C_i$ as shown in FIGS. 8 and 11. In this case, the CPU 11 moves the direction point $b_i$ to the direction of the tangent $T_{i+1}$, so as to make the frequency $X_{bi}$ match with the frequency $X_{pi}$ (step S316).

On the other hand, when the frequency $X_{bi}$ is not less than the frequency $X_{pi}$ (No at step S315), the CPU 11 proceeds to step S317.

Figure 12:
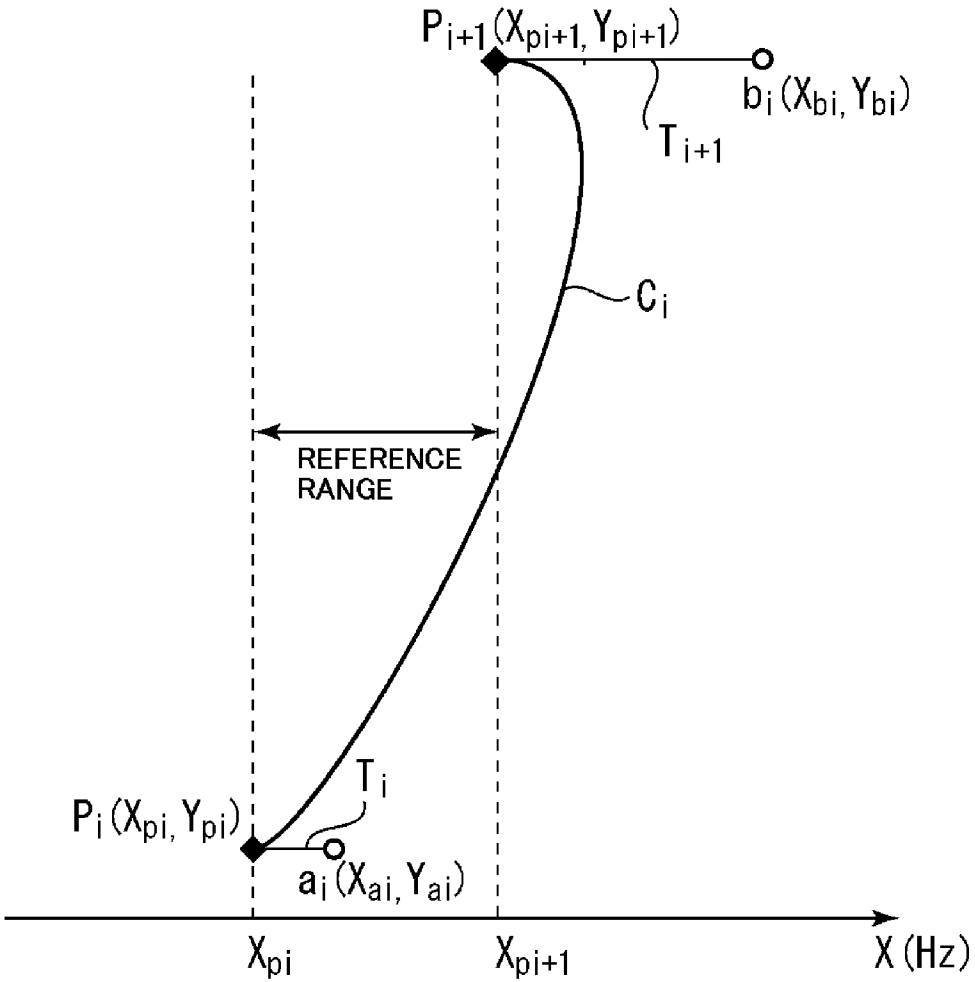
FIG. 12 is a diagram illustrating another example of the Bezier curve shown in FIG. 7 before the pass point reference processing is executed.

FIG. 12 is a diagram illustrating the Bezier curve $C_i$ in the case where frequency $X_{bi}$ of the direction point $b_i$ is higher than the frequency $X_{pi+1}$ of the pass point $P_{i+1}$. When the frequency $X_{bi}$ is higher than the frequency $X_{pi+1}$ (Yes at step S317), the Bezier curve $C_i$ passes through a region of the frequency higher than the frequency $X_{pi+1}$ as shown in FIGS. 8 and 11. This causes a frequency response curve to have a loop shape. The CPU 11 moves the direction point $b_i$ to the direction of the tangent $T_{i+1}$, so as to make the frequency $X_{bi}$ to match with the frequency $X_{pi+1}$ (step S318).

On the other hand, when the frequency $X_{bi}$ is not more than the frequency $X_{pi+1}$ (No at step S317), the CPU 11 ends the pass point reference processing (step S31).

When the direction point $b_i$ is present within the reference range (No at step S315, No at step S317), the CPU 11 does not move the direction point $b_i$.

In such a manner, when a determination is made that the direction point $a_i$ is out of the reference range, the CPU 11 moves the direction point $a_i$ to the direction of the tangent $T_i$ so that the direction point $a_i$ is within the reference range. The similar processing is executed also on the direction point $b_i$. The movement of the direction points $a_i$ and $b_i$ to the direction of the tangent can prevent the shape of the Bezier curve $C_i$ from greatly changing before and after the movement of the direction points $a_i$ and $b_i$.

Further, the frequency $X_{ai}$ of the direction point $a_i$ is made to match with any one of the frequencies $X_{pi}$ and $X_{pi+1}$, so that a moving amount of the direction point $a_i$ can be suppressed. Much the same is true on the direction point $b_i$. As a result, the shape of the Bezier curve $C_i$ can be prevented from greatly changing before and after the movement of the direction points $a_i$ and $b_i$.

{3.5. The Intersection Reference Processing (step S34)}

When the frequency $X_{ai}$ of the direction point $a_i$ is higher than the frequency $X_{bi}$ of the direction point $b_i$ (No at step S32), the CPU 11 executes the intersection reference processing (step S34) as shown in FIG. 7.

Figure 13:
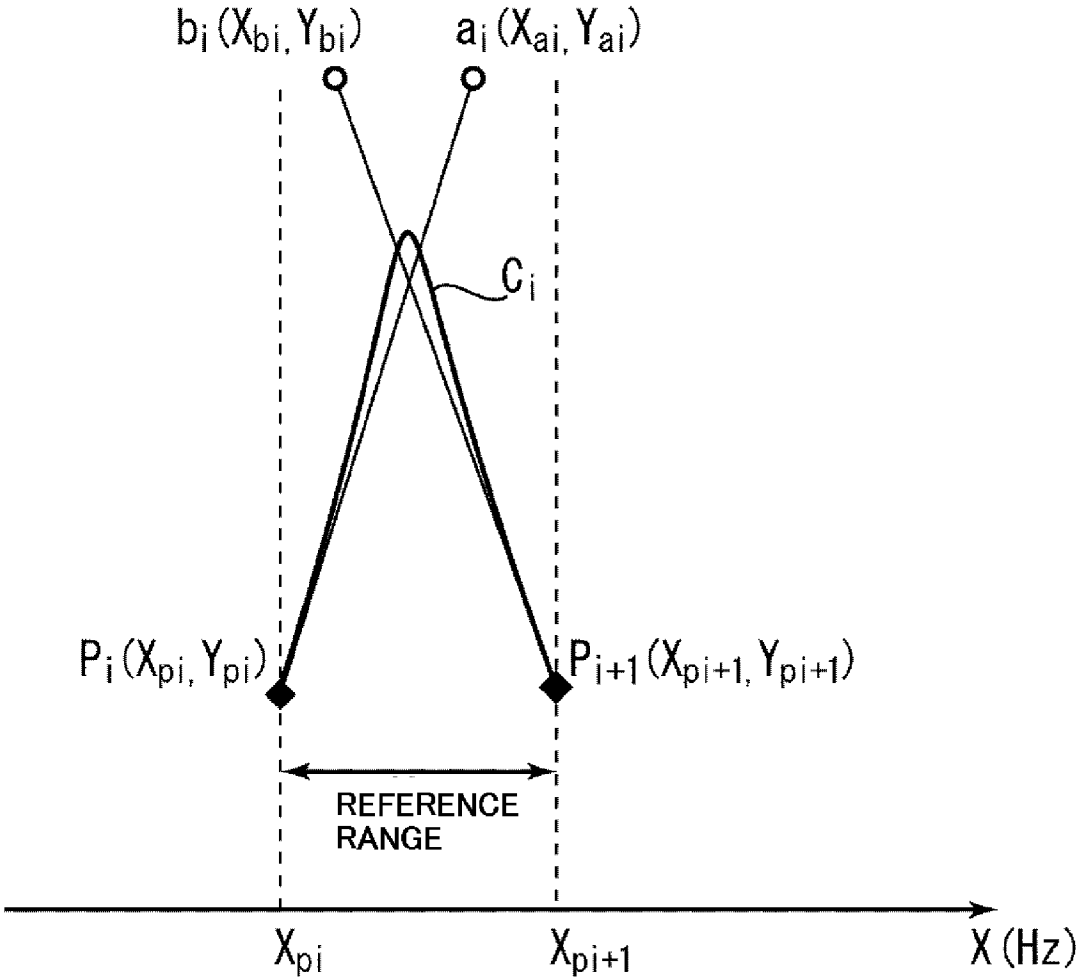
FIG. 13 is a diagram illustrating one example of the Bezier curve shown in FIG. 7 before intersection reference processing is executed.

At first, a reason why the intersection reference processing (step S34) is executed will be described. FIG. 13 is a diagram illustrating the Bezier curve $C_i$ in a case where the frequency $X_{ai}$ is higher than the frequency $X_{bi}$. Both the frequencies $X_{ai}$ and $X_{bi}$ are present within the reference range, but the frequency $X_{ai}$ is higher than the frequency $X_{bi}$ as shown in FIG. 13. In this case, since the Bezier curve $C_i$ draws a sharp peak, an audio with a specific frequency might be enhanced or attenuated despite of the intention of a user. As a result, it is considered that a user feels uncomfortable about an audio output from the speaker 14. The intersection reference processing (step S34) is executed so that a frequency response curve does not have a shape unintended by the user. Further, the intersection reference processing (step S34) prevents the Bezier curve shown in FIG. 6 from having a shape such that a spiral is drawn and gains of an audio signal cannot be uniquely specified.

Figure 14:
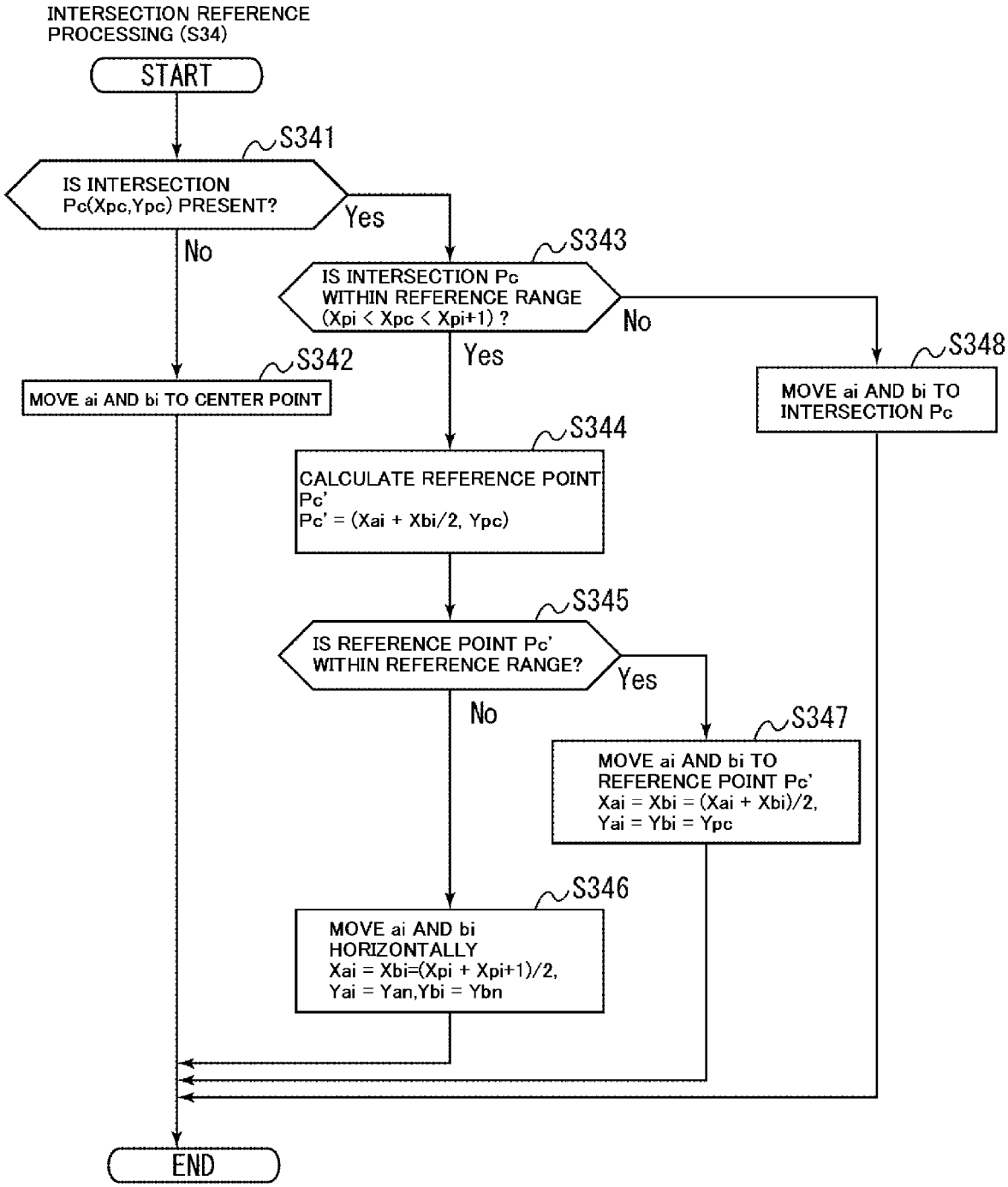
FIG. 14 is a flowchart of the intersection reference processing shown in FIG. 7.

FIG. 14 is a flowchart of the intersection reference processing (step S34). The CPU 11 determines whether the intersection $P_c$ is present as a result of step S33 as shown in FIGS. 4, 7, and FIG. 14 (step S341).

When the intersection $P_c$ is not present (No at step S341), the tangent $T_i$ is parallel with the tangent $T_{i+1}$. In this case, the CPU 11 moves the direction points $a_i$ and $b_i$ to a center point of the direction points $a_i$ and $b_i$ (step S342). Since the direction point $a_i$ matches with the direction point $b_i$, the Bezier curve $C_i$ is a second Bezier curve.

When the intersection $P_c$ is present (Yes at step S341), the CPU 11 determines whether a frequency $X_{pc}$ of the intersection $P_c$ is within the reference range (step S343). The frequencies $X_{pi}$ and $X_{pi+1}$ are not included in the reference range at step S343.

When the frequency $X_{pc}$ is out of the reference range (No at step S343), the CPU 11 moves the direction points $a_i$ and $b_i$ to the intersection $P_c$ (step S348). In this case, the Bezier curve $C_i$ becomes a second Bezier curve similarly to step S342.

On the other hand, when the frequency $X_{pc}$ is within the reference range (Yes at step S343), the CPU 11 calculates a reference point $P_c'$ (step S344). The frequency of the reference point $P_c'$ is an average of the frequency $X_{ai}$ of the direction point $a_i$ and the frequency $X_{bi}$ of the direction point $b_i$. The gain of the reference point $P_c'$ matches with the gain of the intersection $P_c$. The CPU 11 determines whether the reference point $P_c'$ is within the reference range (step S345). The frequencies $X_{pi}$ and $X_{pi+1}$ are not included in the reference range at step S345.

When the reference point $P_c'$ is out of the reference range (No at step S345), the CPU 11 moves the direction points $a_i$ and $b_i$ parallel with a horizontal axis (step S346). Concretely, the CPU 11 moves the direction points $a_i$ and $b_i$ so that the frequency $X_{ai}$ of the direction point $a_i$ and the frequency $X_{bi}$ of the direction point $b_i$ are the frequency of the reference point $P_c'$. The gains of the direction points $a_i$ and $b_i$ are not changed. When step S346 is executed, since the gains of the direction points $a_i$ and $b_i$ are different from each other but the frequencies match with each other, the Bezier curve $C_i$ is still maintained as a third Bezier curve.

On the other hand, when the reference point $P_c'$ is within the reference range (Yes at step S345), the CPU 11 moves the direction points $a_i$ and $b_i$ to the reference point $P_c'$ (step S347). Concretely, the frequency $X_{ai}$ of the direction point $a_i$ and the frequency $X_{bi}$ of the direction point $b_i$ match with the average of the frequencies $X_{ai}$ and $X_{bi}$, and the gains of the direction points $a_i$ and $b_i$ match with the gain of the intersection $P_c$. In this case, the Bezier curve $C_i$ becomes a second Bezier curve similarly to step S342.

In such a manner, when the frequency $X_{ai}$ is higher than the frequency $X_{bi}$, the CPU 11 executes the intersection reference processing (step S34), so as to make at least the frequencies of the direction points $a_i$ and $b_i$ match with each other. As a result, Bezier curve $C_i$ can be prevented from having a sharp peak and from having sound quality that is not intended by the user.

Figure 15:
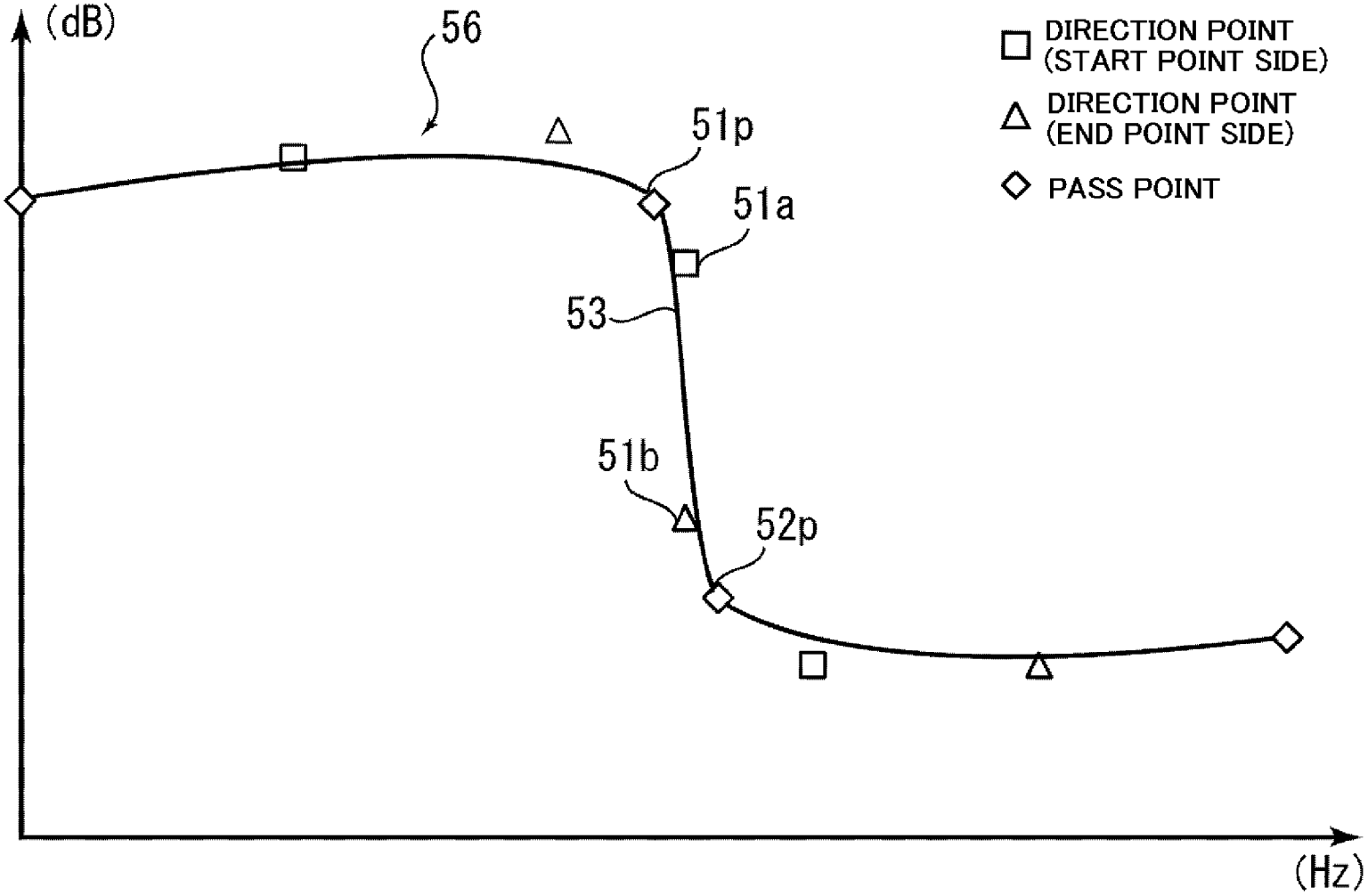
FIG. 15 is a graph illustrating the Bezier curve after direction points are moved in the graph shown in FIG. 5.

FIG. 15 is a graph illustrating the Bezier curve 53 after the direction points 51*a* and 51*b* shown in FIG. 5 are moved by the direction point adjustment processing (step S3).

From FIG. 5 and FIG. 15, it is found that the shape of the Bezier curve 53 changes. This is because the direction points 51*a* and 51*b* are moved to be within the reference range in the pass point reference processing (step S31), and the direction points 51*a* and 51*b* are moved parallel with the horizontal direction in the intersection reference processing (step S34) (step S346). The direction points except for the direction points 51*a* and 51*b* are not moved in the direction point adjustment processing (step S3). The change in the Bezier curve 53 enables the gains to be uniquely specified.

Figure 16:
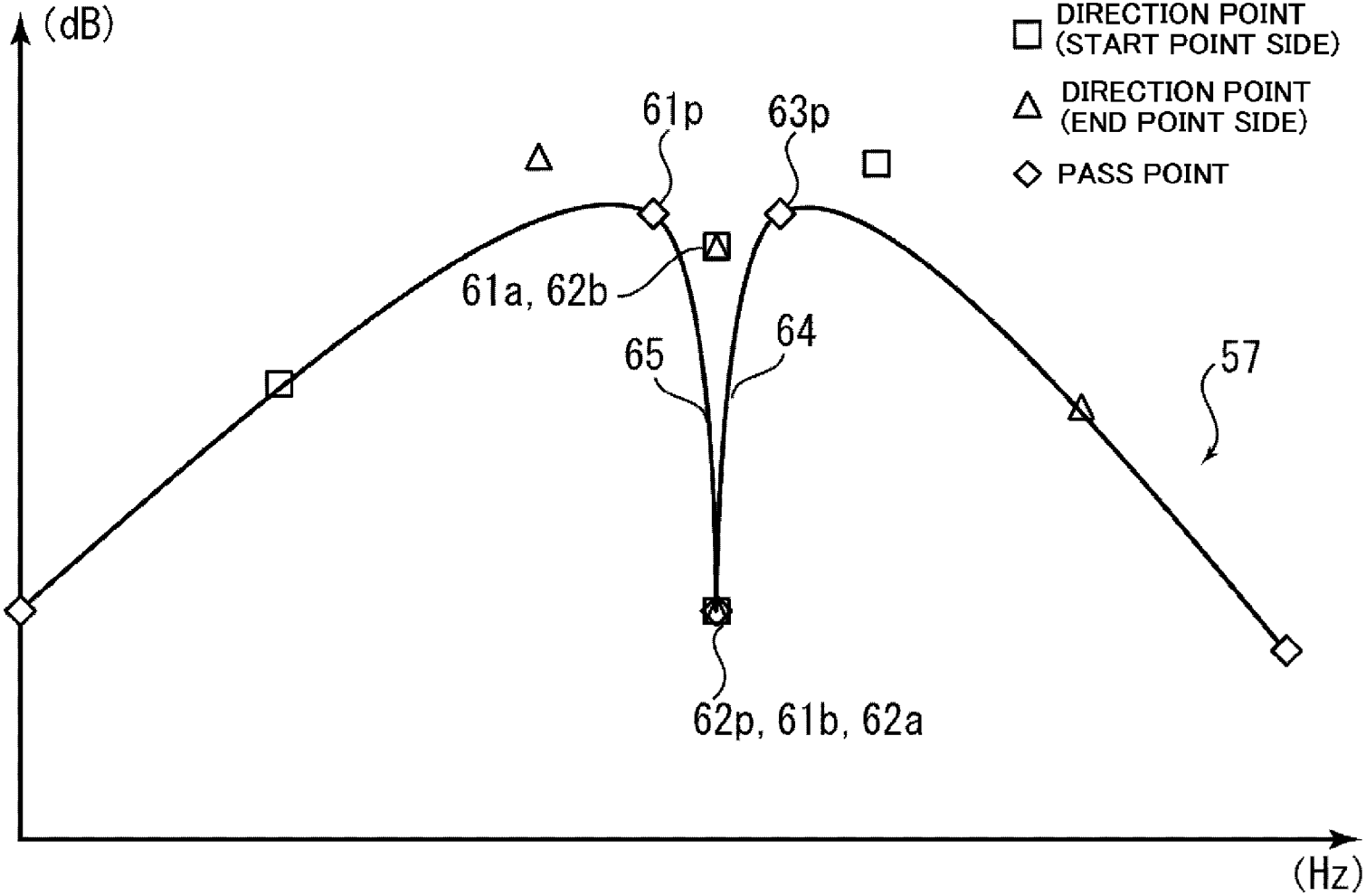
FIG. 16 is a graph illustrating the Bezier curve after the direction points are moved in the graph shown in FIG. 6.

FIG. 16 is a graph illustrating the Bezier curves 64 and 65 after the direction points 61*a*, 61*b*, 62*a*, and 62*b* shown in FIG. 6 are moved in the direction point adjustment processing (step S3). The direction points 61*a*, 61*b*, 62*a*, and 62*b* are moved by the direction point adjustment processing (step S3), but the other direction points are not moved.

Since the frequencies of the direction points 61*a* and 61*b* are higher than the frequency of the pass point 62*p*, the direction points 61*a* and 61*b* are moved so that the frequencies of the direction points 61*a* and 61*b* match with the frequency of the pass point 62*p* (step S31) as shown in FIGS. 6 and 16. As a result, since the frequencies of the direction points 61*a* and 61*b* match with each other (Yes at step S32), the CPU 11 does not execute the intersection reference processing (step S34) on the direction points 61*a* and 61*b*.

Since the frequencies of the direction points 62*a* and 62*b* are lower than the frequency of the pass point 62*p*, the direction points 62*a* and 62*b* move so that the frequencies of the direction points 62*a* and 62*b* match with the frequency of the pass point 62*p* (step S31). As a result, the frequencies of the direction points 62*a* and 62*b* match with each other (Yes at step S32), the CPU 11 does not execute the intersection reference processing (step S34) on the direction points 62*a* and 62*b*.

As a result, the frequency response curve 57 is changed into a shape without a loop as shown in FIG. 16. In FIG. 16, the direction point 61*a* seems to overlap with the direction point 61*b*, but actually the gains of the direction points 61*a* and 61*b* are different from each other. Similarly, the direction points 61*b* and 62*a*, and the pass point 62*p* seem to overlap with one another, but actually, the gains of the direction points 61*b* and 62*a*, and the pass point 62*p* are different from one another. The frequency response curve 57 has a peak whose lower limit is the pass point 62*p*. However, since the pass points 61*p* to 63*p* are set so that the pass point 62*p* is the peak of the lower limit, it is considered that the user has less chance of feeling uncomfortable about sound quality of an audio signal.

The above embodiment describes the example in which the determination program 21 includes the pass point reference processing (step S31) and the intersection reference processing (step S34) in the direction point adjustment processing (step S3), but the present invention is not limited to this. The determination program 21 may be a program for executing only any one of the pass point reference processing (step S31) and the intersection reference processing (step S34).

The above embodiment describes the example in which when the CPU 11 executes the pass point reference processing (step S31: see FIG. 8), it moves the direction point $a_i$ in the direction of the tangent $T_i$, and moves the direction point $b_i$ in the direction of the tangent $T_{i+1}$, but the present invention is not limited to this. The CPU 11 may move, for example, the direction points $a_i$ and $b_i$ parallel with the horizontal axis. Further, the example in which the direction point $a_i$ is moved so that the frequency $X_{ai}$ matches with any one of the frequencies $X_{pi}$ and $X_{pi+1}$ is described, but the present invention is not limited to this. After the movement of the direction point $a_i$, the frequency $X_{ai}$ may be not less than the frequency $X_{pi}$ and not more than the frequency $X_{pi+1}$. That is to say, when the determination is made that the frequency $X_{ai}$ of the direction point $a_i$ is out of the reference range, the CPU 11 may move the direction point $a_i$ so that the frequency $X_{ai}$ is within the reference range in the pass point reference processing (step S31). Much the same is true on the direction point $b_i$.

The embodiment describes the example in which the CPU 11 makes the frequencies $X_{ai}$ of the direction point $a_i$ match with the frequencies $X_{bi}$ of the direction point $b_i$ in the intersection reference processing (step S34), but the present invention is not limited to this . The CPU 11 may move any one of the direction point $a_i$ and the direction point $b_i$ so that the frequency $X_{ai}$ of the direction point $a_i$ is not more than the frequency $X_{bi}$ of the direction point $b_i$. As a result, the Bezier curve $C_i$ can be prevented from drawing an extremely sharp peak.

The embodiment describes the example in which the determination program 21 is installed into the tablet terminal 1, but the present invention is not limited to this. The determination program 21 may be installed into computers such as laptop personal computers, smartphones, and mobile telephones. As a result, these computers can be used as the frequency characteristics determination device.

The above embodiment describes the example in which the determination program 21 is installed into the tablet terminal 1. A method for installing the determination program 21 is not particularly limited. For example, the determination program 21 may be downloaded from a server connected to a network, and installed into the tablet terminal 1. When a medium readable by a computer into which the determination program 21 is recorded (for example, an optical disc, an USB (Universal Serial Bus) memory, a flexible disc or the like) is distributed, the determination program 21 may be installed from the medium into the tablet terminal 1.

The embodiment of the present invention is described above, but the embodiment is only an example for carrying out the present invention. Therefore, the present invention is not limited to the above embodiment, and can be carried out by suitably modifying the above embodiment without deviating from the gist.

What is claimed is:

1. A frequency characteristics determination device comprising:

a setting section for setting a first pass point through which a frequency response curve of an audio signal should pass, and a second pass point whose frequency is higher than a frequency of the first pass point;

a determination section for determining one or more direction points of a Bezier curve connecting the set first and second pass points based on the set first and second pass points;

a range determination section for determining whether frequencies of the one or more direction points determined by the determination section are within a range between not less than the frequency of the first pass point and not more than the frequency of the second pass point;

a moving section for moving the one or more direction points so that frequencies of the direction points are within the range when the determination is made that the frequencies of the direction points are out of the range;

a generation section for generating a Bezier curve based on the one or more direction points and the first and second pass points; and a changing section for changing the frequency response curve of the audio signal according to the Bezier curve generated by the generation section.

2. The frequency characteristics determination device according to claim 1, wherein the one or more direction points include first and second direction points, the range determination section determines whether each of the first and second direction points is within the range.

3. The frequency characteristics determination device according to claim 2, wherein a first tangent of the Bezier curve at the first pass point passes through the first direction point, a second tangent of the Bezier curve at the second pass point passes through the second direction point, and the moving section moves the first direction point along the first tangent, and moves the second direction point along the second tangent.

4. The frequency characteristics determination device according to claim 2, wherein when the frequency of the first direction point is lower than the frequency of the first pass point, the moving section makes the frequency of the first direction point match with the frequency of the first pass point, and when the frequency of the second direction point is lower than the frequency of the first pass point, the moving section makes the frequency of the second direction point match with the frequency of the first pass point, and when the frequency of the first direction point is higher than the frequency of the second pass point, the moving section makes the frequency of the first direction point match with the frequency of the second pass point, and when the frequency of the second direction point is higher than the frequency of the second pass point, the moving section makes the frequency of the second direction point match with the frequency of the second pass point.

5. The frequency characteristics determination device according to claim 2, further comprising:

a comparing section for comparing the frequency of the first direction point with the frequency of the second direction point, wherein when the comparing section determines that the frequency of the first direction point is higher than the frequency of the second direction point, the moving section moves at least one of the first and second direction points so that the frequency of the first direction point is not more than the frequency of the second direction point.

6. A frequency characteristics determination device comprising:

a setting section for setting a first pass point through which a frequency response curve of an audio signal should pass, and a second pass point whose frequency is higher than a frequency of the first pass point;

a determination section for determining first and second direction points of a Bezier curve connecting the set first and second pass points based on the set first and second pass points;

a comparing section for comparing a first frequency of the first direction point through which a tangent of the Bezier curve at the first pass point passes with a second frequency of the second direction point through which a tangent of the Bezier curve at the second pass point passes;

a moving section for, when the comparing section determines that the first frequency is higher than the second frequency, moving at least one of the first and second direction points so that the first frequency is not more than the second frequency;

a generation section for generating a Bezier curve based on the first and second pass points and the first and second direction points; and a changing section for changing the frequency response curve of the audio signal according to the Bezier curve generated by the generation section.

7. A non-transitory recording medium in which a control program is stored, the control program allowing a computer installed into a frequency characteristics determination device to execute:

a step of setting a first pass point through which a frequency response curve of an audio signal should pass and a second pass point whose frequency is higher than a frequency of the first pass point;

a step of determining one or more direction points of a Bezier curve connecting the set first and second pass points based on the set first and second pass points;

a step of determining whether frequencies of the determined one or more direction points are within a range between not less than the frequency of the first pass point and not more than the frequency of the second pass point;

a step of moving the one or more direction points so that frequencies of the one or more direction points are within the range when the determination is made that the frequencies of the one or more direction points are out of the range;

a step of generating a Bezier curve based on the one or more direction points and the first and second pass points;

a step of changing the frequency response curve of the audio signal according to the generated Bezier curve.

8. A non-transitory recording medium in which a control program is stored, the control program allowing a computer installed into a frequency characteristics determination device to execute:

a step of setting a first pass point through which a frequency response curve of an audio signal should pass and a second pass point whose frequency is higher than a frequency of the first pass point;

a step of determining first and second direction points of a Bezier curve connecting the set first and second pass points based on the set first and second pass points;

a step of comparing a first frequency of the first direction point through which a tangent of the Bezier curve at the first pass point passes with a second frequency of the second direction point through which a tangent of the Bezier curve at the second pass point passes;

a step of, when a determination is made that the first frequency is higher than the second frequency, moving at least one of the first and second direction points so that the first frequency is not more than the second frequency;

a step of generating a Bezier curve based on the first and second pass points and the first and second direction points; and a step of changing the frequency response curve of the audio signal according to the generated Bezier curve.

* * * * *